US007278344B2

(12) United States Patent
Pryor et al.

(10) Patent No.: US 7,278,344 B2
(45) Date of Patent: Oct. 9, 2007

(54) SHEAR MECHANISM FOR A SLICING MACHINE

(75) Inventors: Glen F. Pryor, Tinley Park, IL (US); Wayne H. Webster, Wilmington, IL (US); James Wrona, Orland Park, IL (US); Christopher M. Moore, Orland Park, IL (US); Michael S. Nash, Sandwich, IL (US)

(73) Assignee: Formax, Inc., Mokena, IL (US)

( * ) Notice: Subject to any disclaimer, the term of this patent is extended or adjusted under 35 U.S.C. 154(b) by 222 days.

(21) Appl. No.: 10/121,938

(22) Filed: Apr. 11, 2002

(65) Prior Publication Data

US 2002/0166429 A1 Nov. 14, 2002

Related U.S. Application Data

(60) Provisional application No. 60/287,134, filed on Apr. 27, 2001.

(51) Int. Cl.

| | |
|---|---|
| ***B26D 1/11*** | (2006.01) |
| ***B26D 1/157*** | (2006.01) |
| ***B26D 3/20*** | (2006.01) |
| ***B26D 5/12*** | (2006.01) |
| ***B26D 5/16*** | (2006.01) |
| ***B26D 7/06*** | (2006.01) |

(52) U.S. Cl. ..... 83/272; 83/404.1; 83/408; 83/425.3; 83/620; 83/628; 83/639.7; 83/751; 83/786; 83/932

(58) Field of Classification Search ..... 83/404.1, 83/404.4, 408, 425.2, 425.3, 427, 751, 411.2, 83/404, 428, 514, 618, 620, 628, 639.1, 639.7, 83/662, 783, 784, 786, 821, 932
See application file for complete search history.

(56) References Cited

U.S. PATENT DOCUMENTS

| | | | | |
|---|---|---|---|---|
| 264,114 | A * | 9/1882 | Streicher et al. | 83/404.1 |
| 692,594 | A * | 2/1902 | Ballbach | 83/751 |
| 733,976 | A * | 7/1903 | Lacour et al. | 83/404.1 |
| 1,430,049 | A * | 9/1922 | Applegate | 83/395 |
| 1,556,053 | A * | 10/1925 | Warren et al. | 99/538 |
| 1,999,449 | A * | 4/1935 | Erickson | 83/751 |
| 2,024,517 | A * | 12/1935 | Fowler | 83/751 X |
| 2,288,986 | A * | 7/1942 | Yuhas | 83/404.1 |
| 2,327,018 | A * | 8/1943 | Criner | 83/751 |
| 3,463,211 | A * | 8/1969 | Holz | 83/404.3 |
| 3,614,970 | A * | 10/1971 | Webb et al. | 83/408 |

(Continued)

FOREIGN PATENT DOCUMENTS

| | | |
|---|---|---|
| DE | 93 11 101 U | 11/1993 |

(Continued)

*Primary Examiner*—Clark F. Dexter
(74) *Attorney, Agent, or Firm*—The Law Office of Randall T. Erickson, P.C.

(57) ABSTRACT

A slicing machine includes a machine frame having a food loaf delivery path arranged in a longitudinal direction, and a cutting assembly arranged in the delivery path. The cutting assembly has two longitudinally directed reciprocating blades facing upstream in the delivery path. In operation, the loaf is pressed through the cutting assembly which cuts the loaf into quarter sections. A slicing blade is arranged in the delivery path downstream of the cutting assembly, the slicing blade arranged to slice the sectioned food loaf transversely to the longitudinal direction.

12 Claims, 20 Drawing Sheets

U.S. PATENT DOCUMENTS

| | | | | | |
|---|---|---|---|---|---|
| 3,780,611 | A | * | 12/1973 | Beckman | 83/751 |
| 4,771,664 | A | * | 9/1988 | Holz | 83/751 X |
| 5,343,790 | A | * | 9/1994 | Kuhrt | 83/932 X |
| 5,566,600 | A | | 10/1996 | Johnson et al. | |
| 5,649,463 | A | | 7/1997 | Lindee et al. | |
| 5,704,265 | A | | 1/1998 | Johnson et al. | |

FOREIGN PATENT DOCUMENTS

| | | | |
|---|---|---|---|
| DE | 296 04 274 | U1 | 4/1996 |
| EP | 0 713 753 | A2 | 5/1996 |
| EP | 0 908 279 | A | 4/1999 |
| FR | 1 115 021 | A | 4/1956 |
| GB | 1 144 724 | A | 3/1969 |
| OA | 6 733 | A | 6/1982 |
| WO | WO92 09411 | | 6/1992 |
| WO | WO93 10948 | | 6/1993 |
| WO | WO99/08844 | | 2/1999 |

* cited by examiner

SHEAR MECHANISM FOR A SLICING MACHINE

The application claims the benefit of Provisional Application Ser. No. 60/287,134 filed Apr. 27, 2001.

TECHNICAL FIELD OF THE INVENTION

The present invention relates to slicing devices, particularly to machines for slicing food product loaves into portions.

BACKGROUND OF THE INVENTION

Many different kinds of food loaves are produced in a wide variety of shapes and sizes. Meat loaves consisting of ham, pork, beef, lamb, turkey, fish and other meats have been commercialized. Such meat loaves or cheese loaves or other food loaves are commonly sliced and collected in groups in accordance with a particular weight requirement, the groups being packaged and sold at retail. The number of slices in a group may vary depending on the size and consistency of the food loaf. For some products, neatly aligned stacked sliced groups are preferred, while for other products the groups are shingled so that a purchaser can see a part of every slice through transparent packaging.

Typically, round cross-section or square-section food loaves are sliced into thin slices which are stacked or shingled in groups to be packaged and sold. These slices are then used by the consumer as cold cuts for sandwiches, and the like.

The present inventor has recognized that it would be desirable to provide a machine which sliced food loaves into cross-sectional slices and also sliced the cross-sectional slices into smaller pieces. The present inventor has recognized that such smaller pieces would be desired by consumers as hors d'oeuvres, small snack slices, toppings for pizza, ingredients for soups or salads, or other uses where a small slice food piece is desired.

SUMMARY OF THE INVENTION

One aspect of the present invention provides a shear mechanism or cutting assembly for a slicing machine, the slicing machine having a transverse cutting blade for transversely cutting a food loaf into cross-sectional slices, the cutting assembly comprising at least one longitudinally directed cutting blade which severs or divides the food loaf upstream of the transverse cutting blade, making a division or cut plane in the food loaf the cut plane extending in a longitudinal direction. Preferably, the cutting assembly includes a vertical, longitudinal cutting blade and a horizontal, longitudinal cutting blade. The output of the slicing machine, given the combined effect of the transverse cutting blade and the horizontal and vertical longitudinal cutting blades, is a plurality of stacked or shingled and quartered slices. The quartered slices each comprise four small pieces.

The sliced pieces can be advantageously sized for small food product needs, such as pizza toppings, hors d'oeuvres, small snack slices, ingredients for soups or salads, or other uses.

In a preferred embodiment, the cutting assembly comprises a housing having a perimeter and through-openings or voids for guiding food product loaves through the housing in a longitudinal direction. A vertical longitudinally directed cutting blade is centered within each void. A horizontal longitudinally directed cutting blade is centered within the voids, arranged perpendicularly to each vertical longitudinally directed cutting blade. The vertical and horizontal longitudinally directed cutting blades have sharp edges, preferably serrated, facing upstream in the longitudinal direction, perpendicular to axes of both the vertical and horizontal longitudinally directed cutting blades.

The vertical longitudinally directed cutting blades are mounted to a first frame which is carried by the housing. The first frame is guided for vertical reciprocating movement with respect to the housing. The horizontal longitudinally directed cutting blade is mounted to a second frame which is carried by the housing and guided for horizontal reciprocating movement with respect to the housing. The horizontal and vertical cutting blades reciprocate in planes slightly offset along the longitudinal direction so as not to interfere. The first frame carries a cam slot and the second frame carries a cam follower, the cam follower residing within the cam slot, such that horizontal reciprocating movement of the second frame, vertically reciprocates the first frame.

The housing carries at least one double acting cylinder which drives the second frame into horizontal reciprocation. Preferably, two parallel double acting cylinders are used for increased power and reliability.

Another aspect of the invention provides a slicing apparatus that includes a mechanism for driving crossing, longitudinally directed cutting blades for longitudinally dividing a food loaf.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
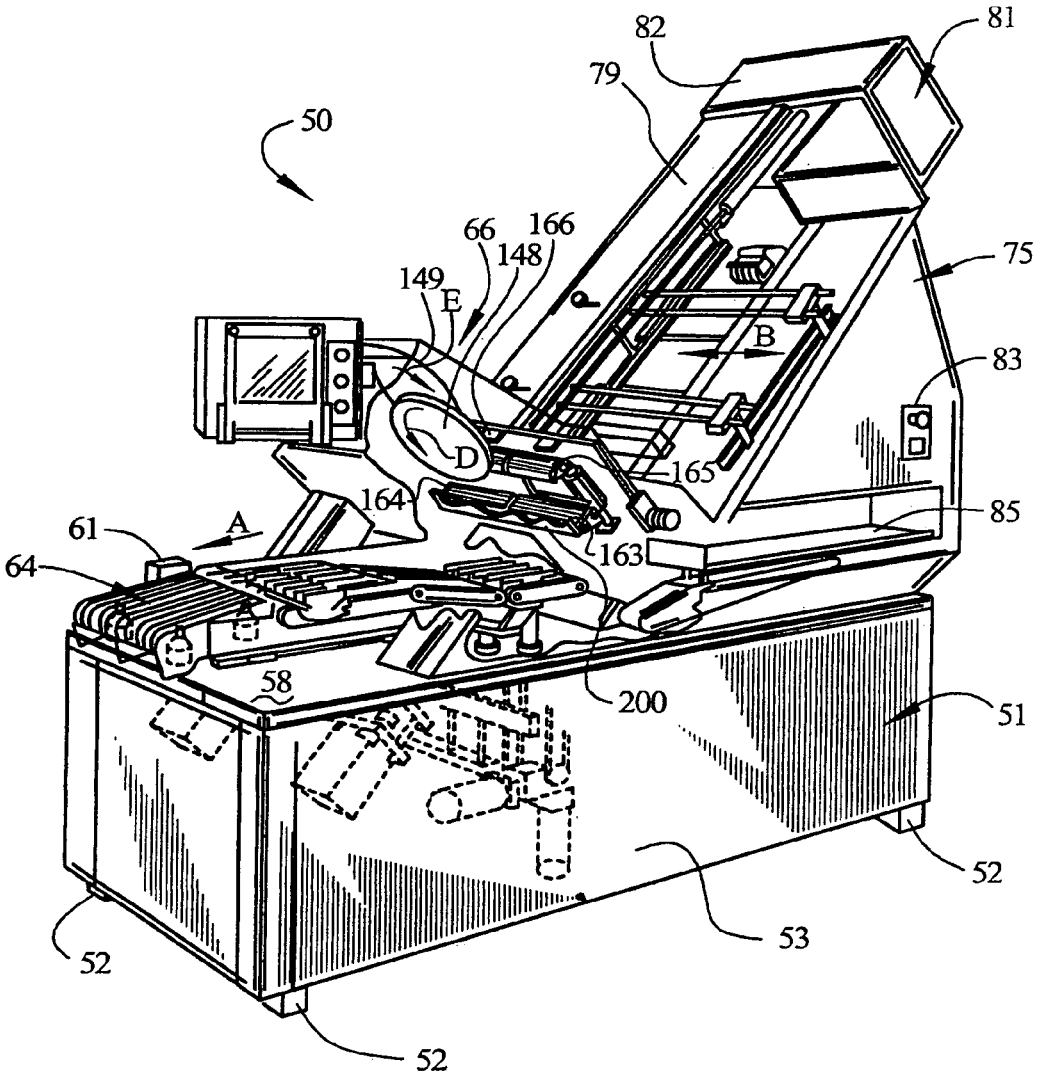
FIG. 1 is a perspective view of a slicing machine according to one aspect of the invention, including a longitudinal cutting assembly.

While this invention is susceptible of embodiment in many different forms, there are shown in the drawings, and will be described herein in detail, a specific embodiment thereof with the understanding that the present disclosure is to be considered as an exemplification of the principles of the invention and is not intended to limit the invention to the specific embodiment illustrated.

FIG. 1 illustrates a versatile, high-speed food loaf slicing machine 50. Such a machine is disclosed for example in U.S. Pat. No. 5,704,265 or EP 0 713 753 A2, or WO 99/08844, dated Feb. 25, 1999, all herein incorporated by reference. The slicing machine 50 comprises a base 51 mounted upon four fixed pedestals or feet 52, and has a housing or enclosure 53 surmounted by a top 58. The enclosure can house a operating computer, electrical power supply, a scale mechanism, and a pneumatic or hydraulic supply, or both (not shown). The slicing machine 50 includes a conveyor drive 61 used to drive an output conveyor/classifier system 64.

The upper right-hand portion of slicing machine 50, as seen in FIG. 1, comprises a loaf feed mechanism 75 including a manual loaf loading door 79 and a near-side automatic loaf loading door (not shown). The slicing machine 50 further includes a pivotable upper back frame 81 and a housing 82. A loaf feed guard 83 protects the near-side of the loaf feed mechanism 75. Behind loaf feed guard 83 there is a loaf lift tray 85, employed for automated loading of a food loaf into the machine 50. A fixed loaf storage tray, used for manual loaf loading, is located on the opposite side of the slicing machine 50.

The slicing machine 50 produces a series of stacks of food loaf slices that are set outwardly of the machine, in a direction of the arrow A, by the conveyor/classifier system 64 of the present invention. According to the disclosed preferred embodiment of the present invention, four rows of food loaf slices are produced from four side-by-side loaves. Although four rows are illustrated, any number of rows, one, two, or more, are encompassed by the invention.

The slicing machine 50 includes a fixed frame pivotally supporting the automated feed mechanism 75 for feeding food loaves into a slicing station 66. The slicing station 66 includes a rotating spindle or head 148. The head 148 is driven to rotate counterclockwise, as indicated by arrow D. The range of head speeds is quite large and may typically be from 10 to 750 rpm. A round knife blade 149 is shown rotatably mounted at a non-centralized location on the head 148. The knife blade 149 is driven separately from the head 148, rotating clockwise in the direction of arrow E. The range of knife blade speeds again is quite large and may typically be from 10 to 4,600 rpm. The blade 149 thus performs an orbital motion and also rotates. Other slicing head constructions may be used in machine 50, such as an the designs disclosed in WO 99/08844 herein incorporated by reference. The cutting edge of knife blade 149 moves along a predetermined cutting path to cut a slice from each of one, two, or more food loaves in each cycle of operation.

The slicing machine 50 further comprises a system of short conveyors for advancing food loaves from loaf feed mechanism 75 into slicing head 66. FIG. 1 illustrates two short lower loaf feed conveyors 163 and 164 on the near and far sides of the slicing machine 50, respectively. These short lower conveyors 163 and 164 are located immediately below two short upper feed conveyors 165 and 166, respectively. As used in describing conveyors 163-166, the term "short" refers to the length of the conveyors parallel to the food loaf path (the longitudinal direction). The upper conveyor 165 of the pair 163 and 165 is displaceable so that the spacing between conveyors 163 and 165 can be varied to accommodate food loaves of varying height.

Directly behind the conveyors 163-166, and upstream of the knife 149 is a cutting assembly 200 for dividing or shearing the food loaf in the longitudinal direction before the loaves are sliced by the knife 149. The assembly 200 is shown broken away in order to view the conveyors 163-166, but is described in detail in the following figures and description.

Figure 2:
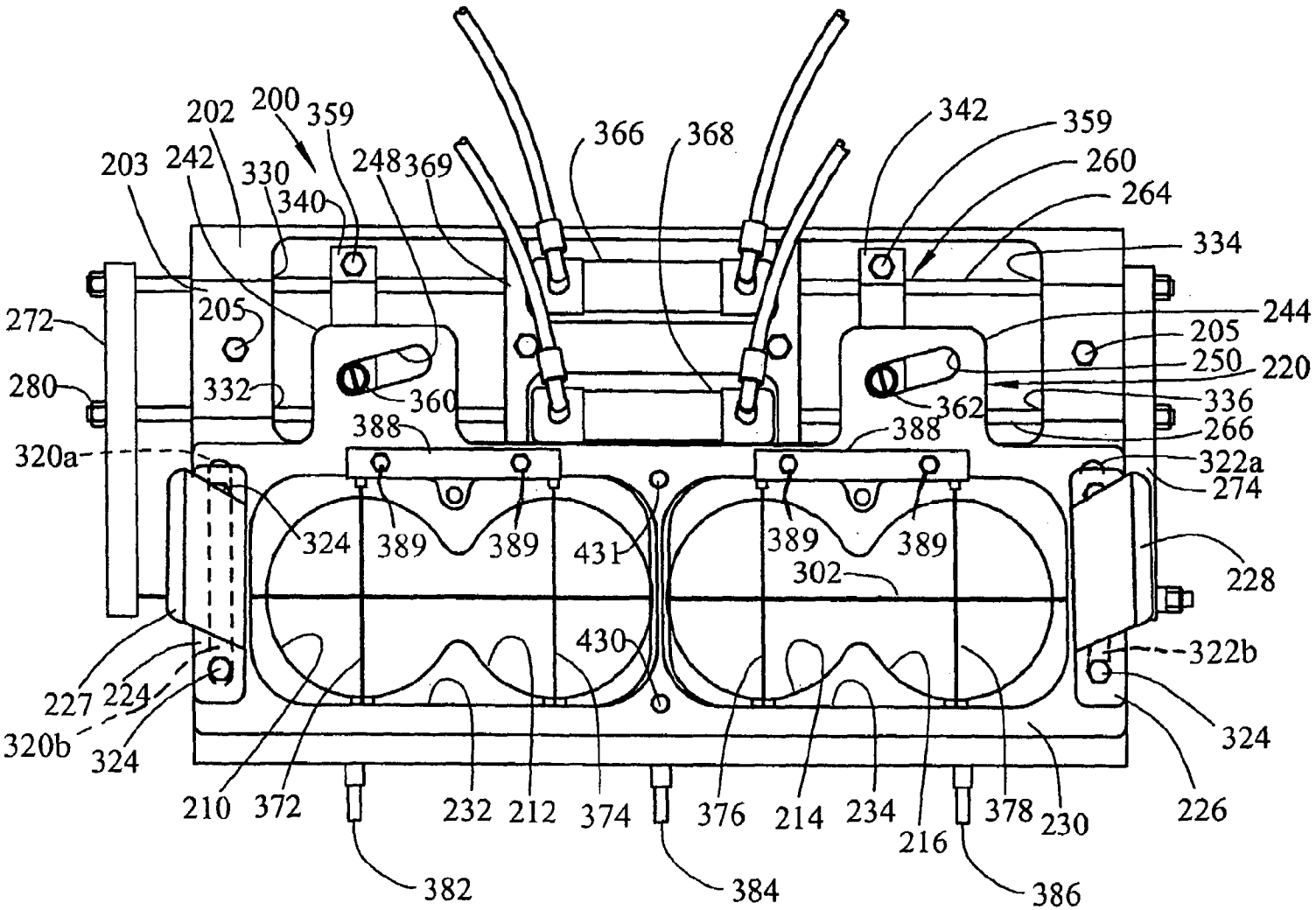
FIG. 2 is a rear view of the cutting assembly of FIG. 1 including a housing, a first frame, and a second frame, in a first position.

FIG. 2 illustrates the cutting assembly 200 in isolation from the machine shown in FIG. 1. The cutting assembly 200 includes a housing 202, preferably composed of plastic, having a plurality of voids therethrough. In the exemplary embodiment, four voids 210, 212, 214, 216 are used, comprising two pairs of connected voids. The voids act to guide food loaves through the cutting assembly 200 as the loaves are conveyed through the slicing machine to the transverse slicing blade 149.

A first frame 220 is carried by the housing. The first frame 220 is mounted to the housing 202 and guided for reciprocating vertical movement, by lateral brackets 224, 226. The brackets 224, 226 include guide plates 227, 228 respectively, for guiding food loaves into the voids 210, 216. The first frame includes a generally rectangular surrounding rim 230 defining one or more open spaces 232, 234 which are substantially in registry with the voids 210, 212, 214, 216. The first frame includes tab portions 242, 244 extending upwardly from the rim 230. The tab portions 242, 244 include angled cam slots 248, 250 respectively.

Figure 11:
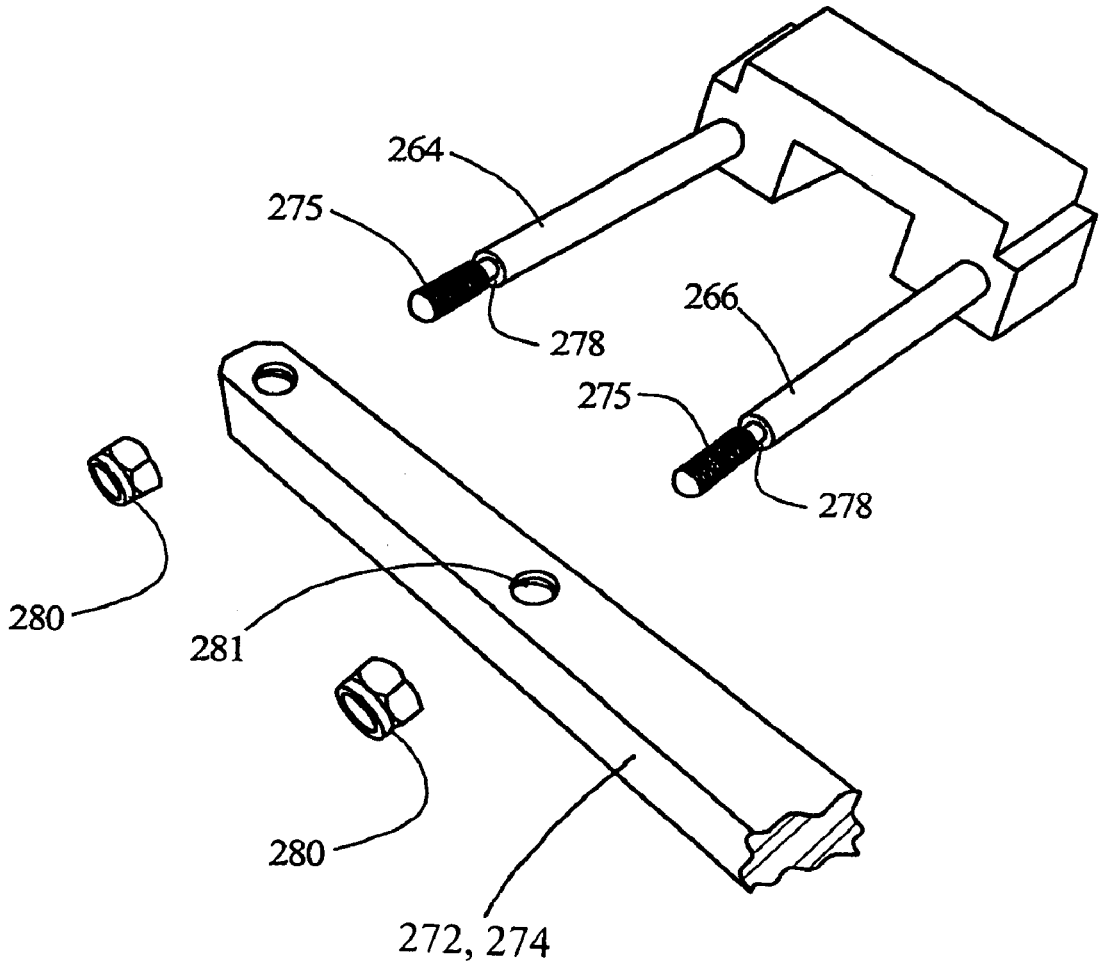
FIG. 11 is a fragmentary, exploded perspective view of a portion of the second frame.

A second frame 260 is mounted in front of the first frame 220 (behind the first frame in the rear view of FIG. 2). The second frame 260 includes parallel rods or rails 264, 266 extending horizontally, and parallel end plates 272, 274 extending perpendicular thereto, each end plate connected to respective threaded ends 275 of the rails using a shoulder 278 on the rail and a separate nut 280, respectively (shown in FIG. 11). The shoulders 278 fit within countersunk holes 281 through the end plates 272, 274. The threaded ends 275 extend through the holes 281. The end plates 272, 274 are located outside of the housing 202.

A horizontal longitudinal blade 302 is fixed at opposite ends to the end plates 272, 274.

The first frame 220 is guided by end slots 320*a*, 320*b*; 322*a*, 322*b*, (shown in FIG. 14) respectively formed through lateral ends of the rim 230, and fasteners 324 that fix the brackets 224, 226 to the housing and extend through the end slots 320*a*, 320*b*; 322*a*, 322*b*. The fasteners have threaded ends that engage threaded holes 326 in the housing 202

Figure 14:
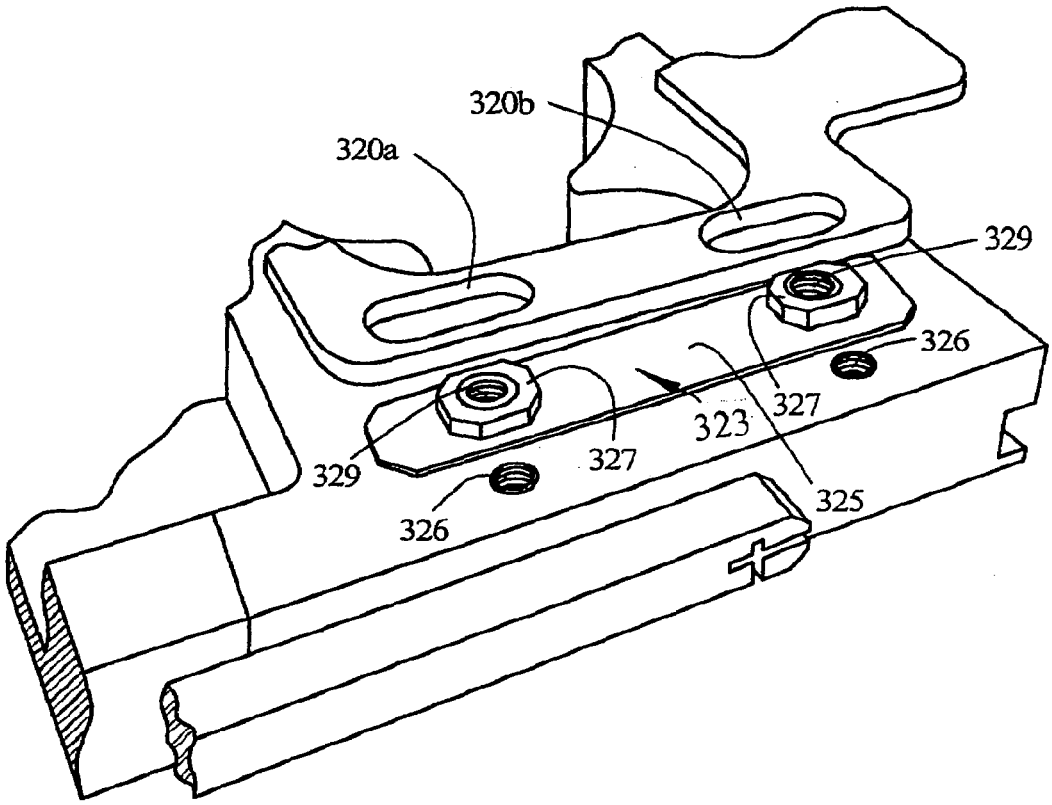
FIG. 14 is a fragmentary, exploded perspective view of a portion of the cutting assembly.

(shown in FIG. 14). An intermediate bearing 323 includes a plastic plate 325 and oblong plastic guides 327 that provide friction-reducing sliding and guiding surfaces within the end slots (shown in FIG. 14). Steel spacer bushings 329 are set within the guides 327 for setting the clearance between the housing 202 and the brackets 224, 226.

Figure 7:
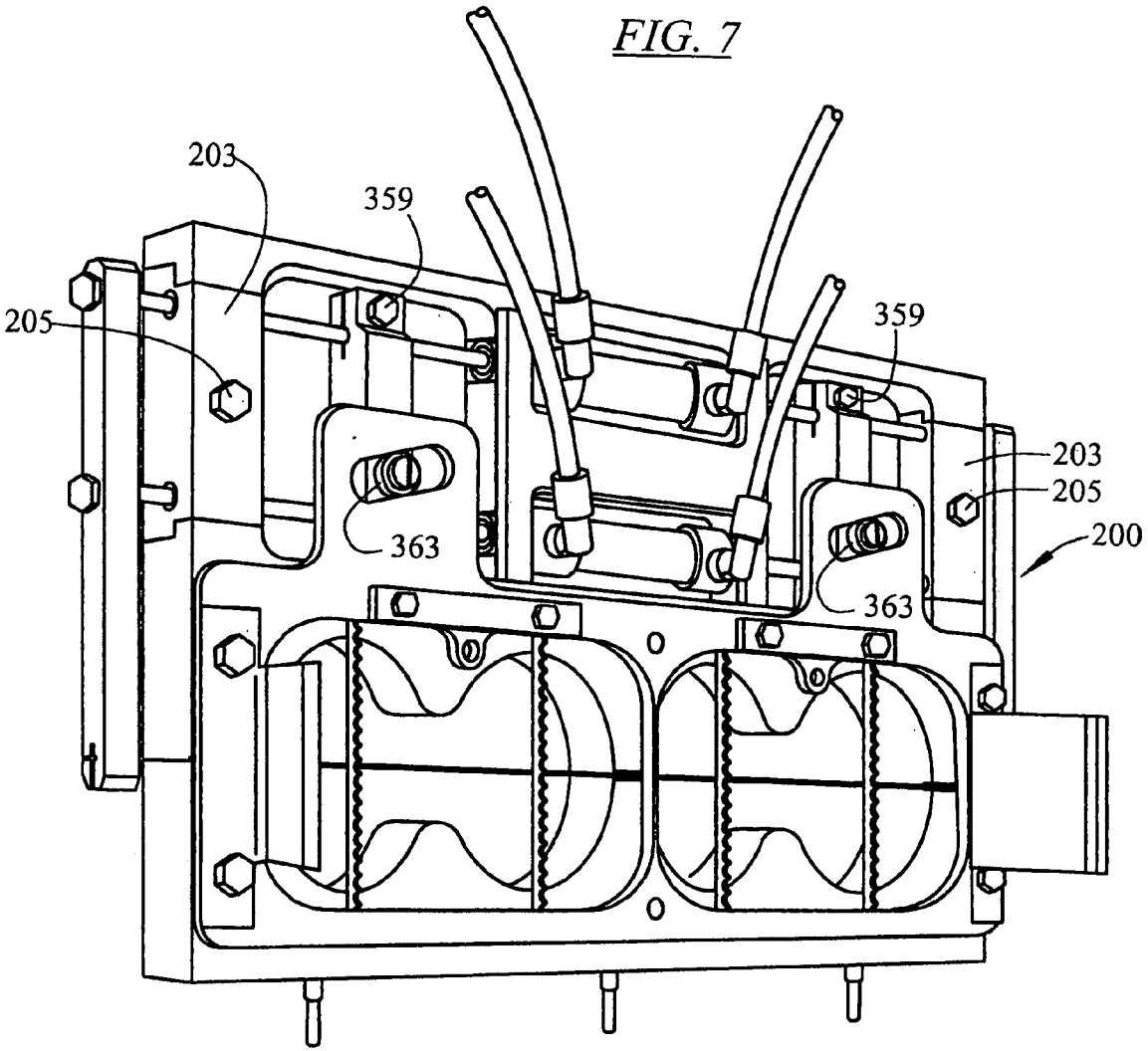
FIG. 7 is a rear perspective view of the cutting assembly of FIG. 3.
Figure 12:
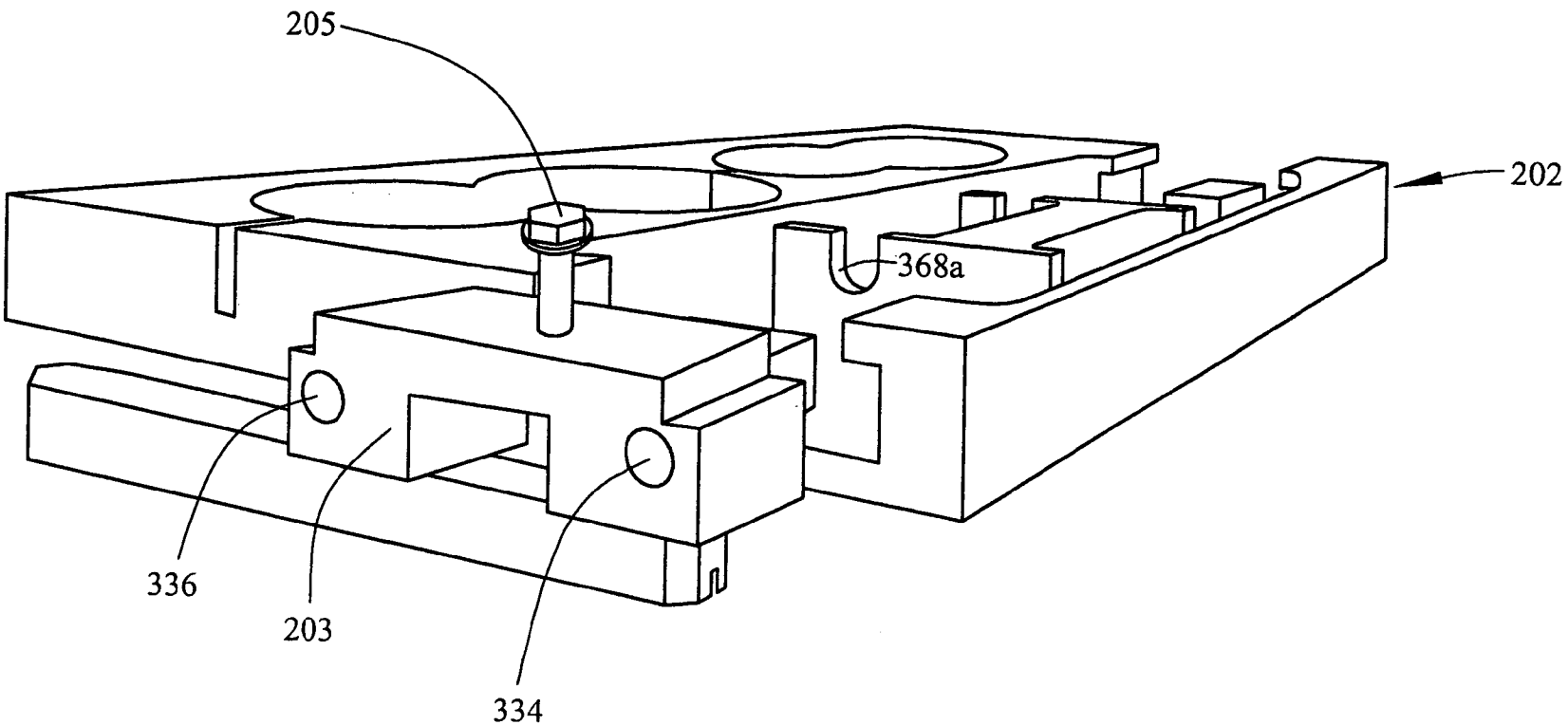
FIG. 12 is a fragmentary, exploded perspective view of a portion of the housing of the cutting assembly.
Figure 13:
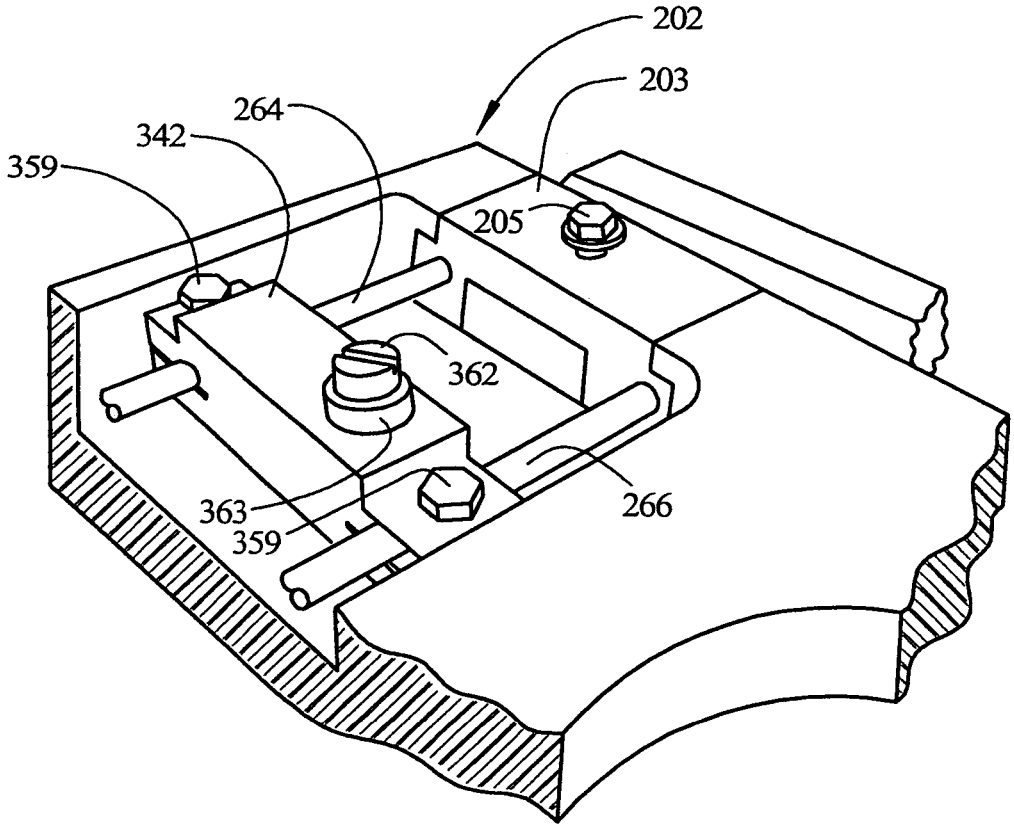
FIG. 13 is a fragmentary perspective view of a portion of the second frame and the housing of the cutting assembly.

The second frame 260 is guided by the rails penetrating through guide holes 330, 332, 334, 336 formed transversely through side wall blocks 203 of the housing 202 (shown in FIGS. 12 and 13). The blocks 203 are fastened to the remaining portions of the housing 202 by fasteners 205. The blocks are removable to facilitate assembly/disassembly of the cutting assembly 200. Brackets 340, 342 are fixedly connected to the rails 264, 266 within the perimeter of the housing 202 by two clamping arrangements each effected by a fastener 359 (shown in FIGS. 7 and 13). A pin 360, 362 (see FIG. 13) extends from each bracket 340, 342 into the cam slots 248, 250. The pins include plastic rings 363 for reduced friction sliding (shown in FIGS. 7 and 13) within the cam slots.

Two dual acting cylinders 366, 368 act on the rails 264, 266 to drive the rails in horizontal reciprocation. In this regard, a piston (not shown) is connected to each of the rails within the dual acting cylinders, and pneumatic or hydraulic pressure acting on opposite sides of the piston drives the rails into reciprocation. The reciprocation of the rails causes the reciprocation of the horizontal, longitudinally directed blade 302 and causes vertical reciprocation of the four vertical longitudinally directed blades 372, 374, 376, 378, by driving the pins 360, 362 through the cam slots 248, 250. Although two dual acting cylinders are illustrated, a single dual acting cylinder is also encompassed by the invention. Using two dual acting cylinders provide increased power and reliability.

Figure 19:
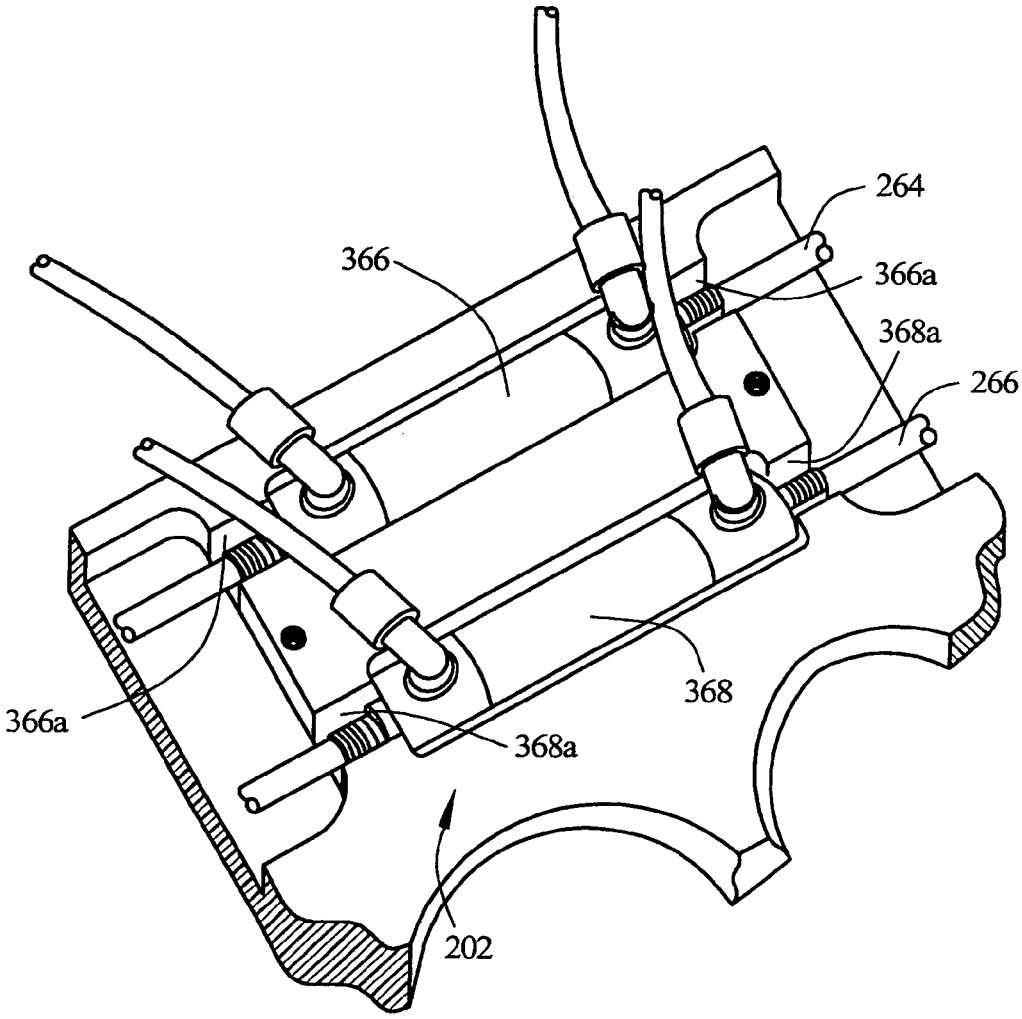
FIG. 19 is a fragmentary perspective view of a portion of the second frame of the cutting assembly.
Figure 20:
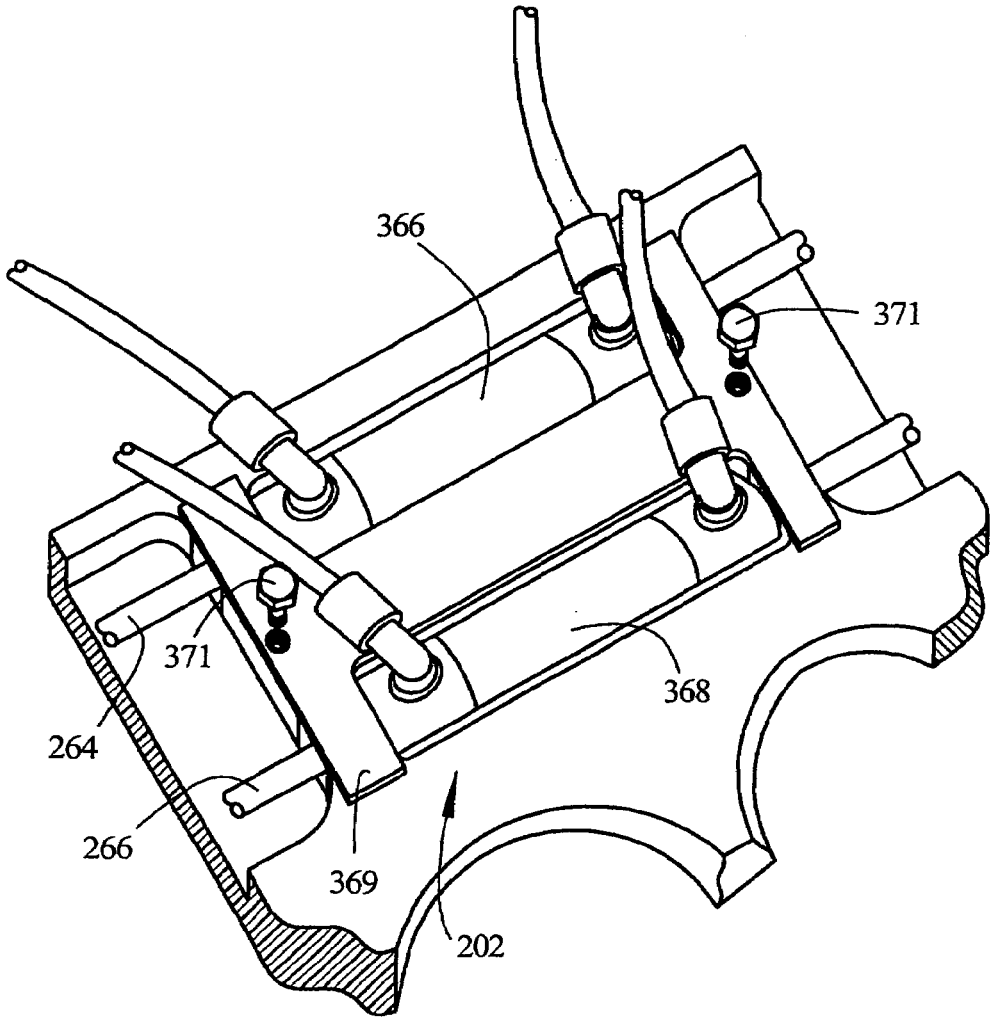
FIG. 20 is a fragmentary perspective view of a portion of the cutting assembly.

The cylinder 366, 368 are fit into formed slots 366*a*, 368*a* of the housing (shown in FIG. 19). An H-shaped plate 369 is fastened by fastener 371 to the housing 202 over the slots 366*a*, 368*a* to capture the cylinders 366, 368 onto the housing (shown in FIG. 20).

The threaded fasteners 382, 384, 386 protrude through a bottom of the housing 202 for attachment of the cutting assembly to the machine frame.

Figure 8:
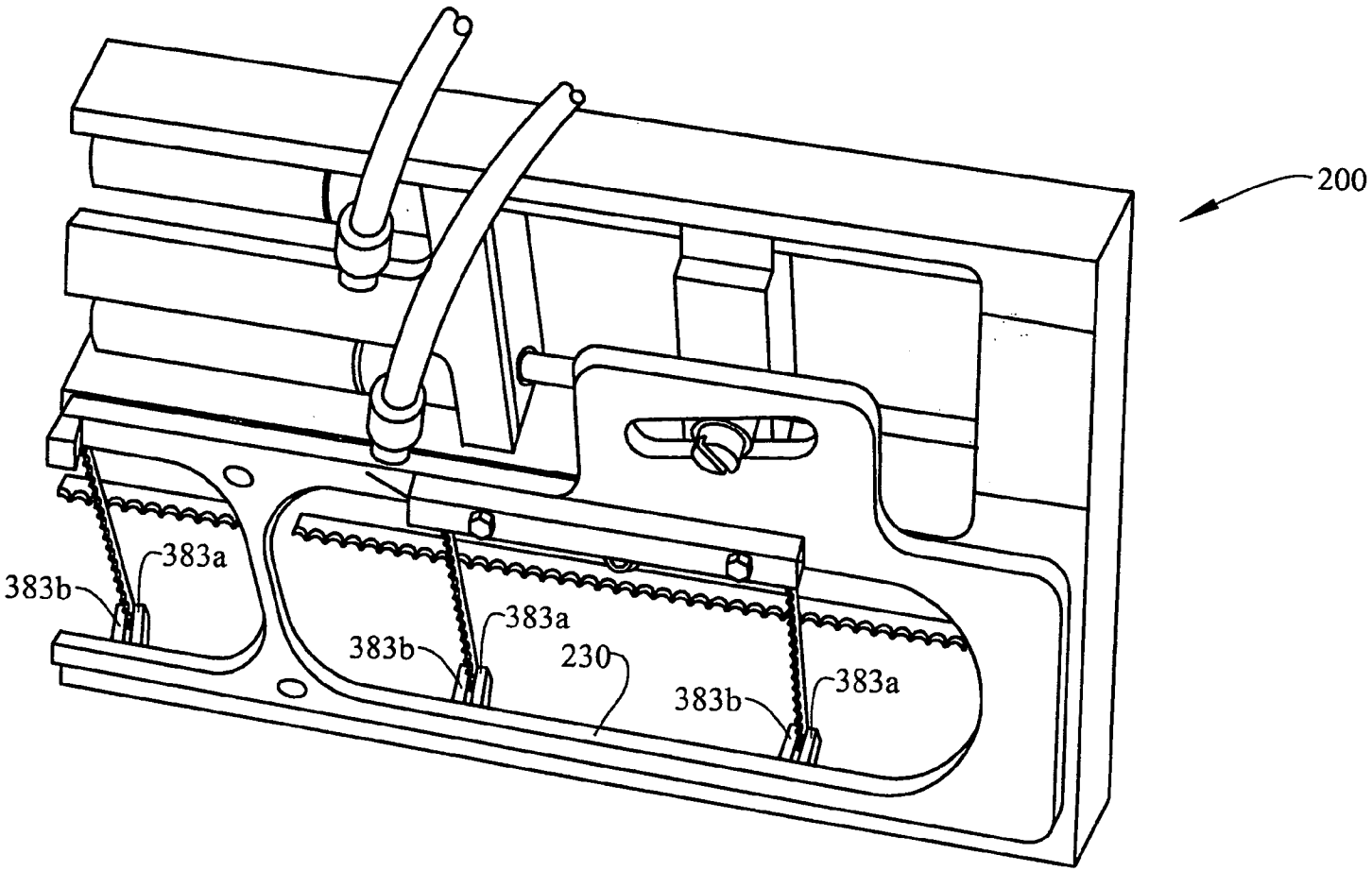
FIG. 8 is an enlarged perspective view taken from FIG. 5.
Figure 16:
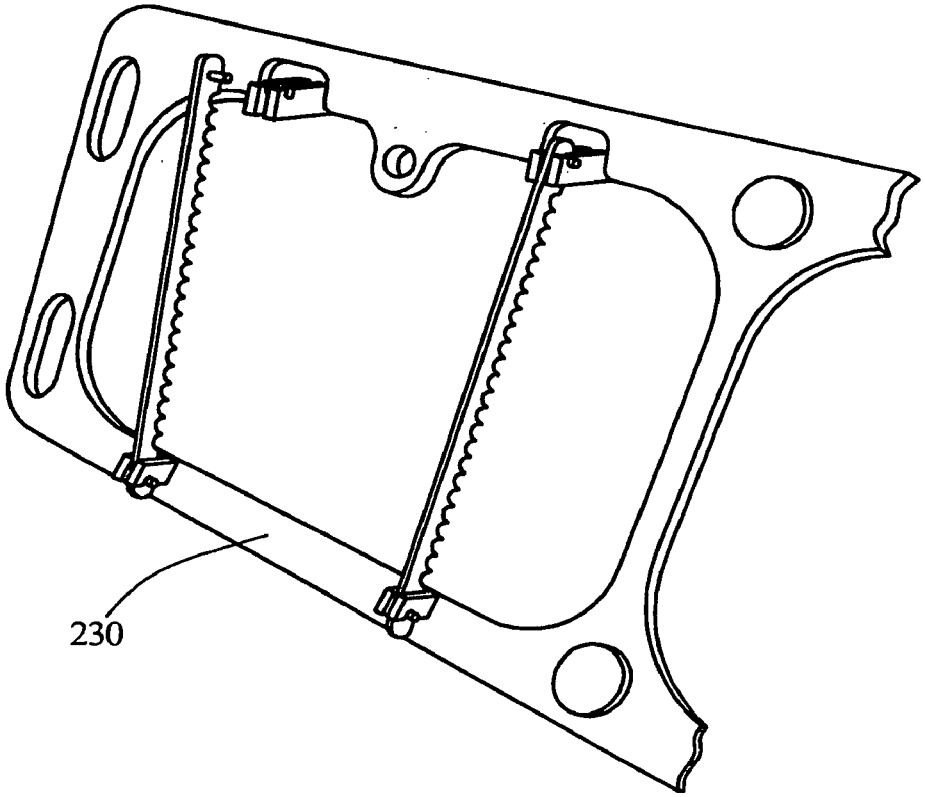
FIG. 16 is a fragmentary, exploded perspective view of a portion of the first frame of the cutting assembly.
Figure 16B:
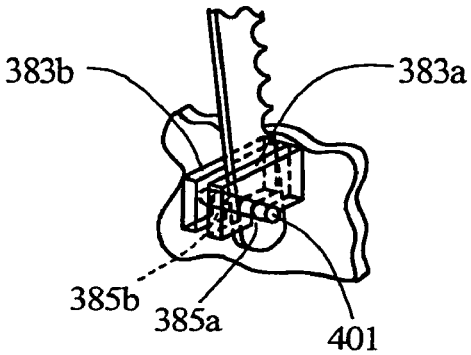
FIG. 16*b* is a fragmentary perspective view of a portion of the first frame of the cutting assembly.
Figure 16A:
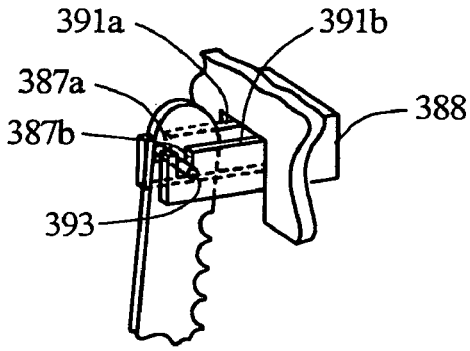
FIG. 16*a* is a fragmentary perspective view of a portion of the first frame of the cutting assembly.

As illustrated in FIGS. 16 and 16*a*, the first frame rim 230 includes upper blade holding channels 387*a*, 387*b* formed by upper lugs 391*a*, 391*b* extending from a retainer plate 388. A through-pin 393, carried by each blade 372, 374, 376, 378 seats within the channels 387*a*, 387*b*. The securing of the retainer plate 388 by fasteners 389 to the first frame rim 230 fixes a top end of the vertical longitudinally directed cutting blades to the first frame. As illustrated in FIGS. 8, 16, and 16*b*, a bottom end of each vertical longitudinally directed cutting blade carries a through-pin 401 which is held in lower blade holding channels 385*a*, 385*b* formed by lower lugs 383*a*, 383*b* of the rim 230 (shown in FIGS. 8, and 16 and 16*b*).

Figure 17:
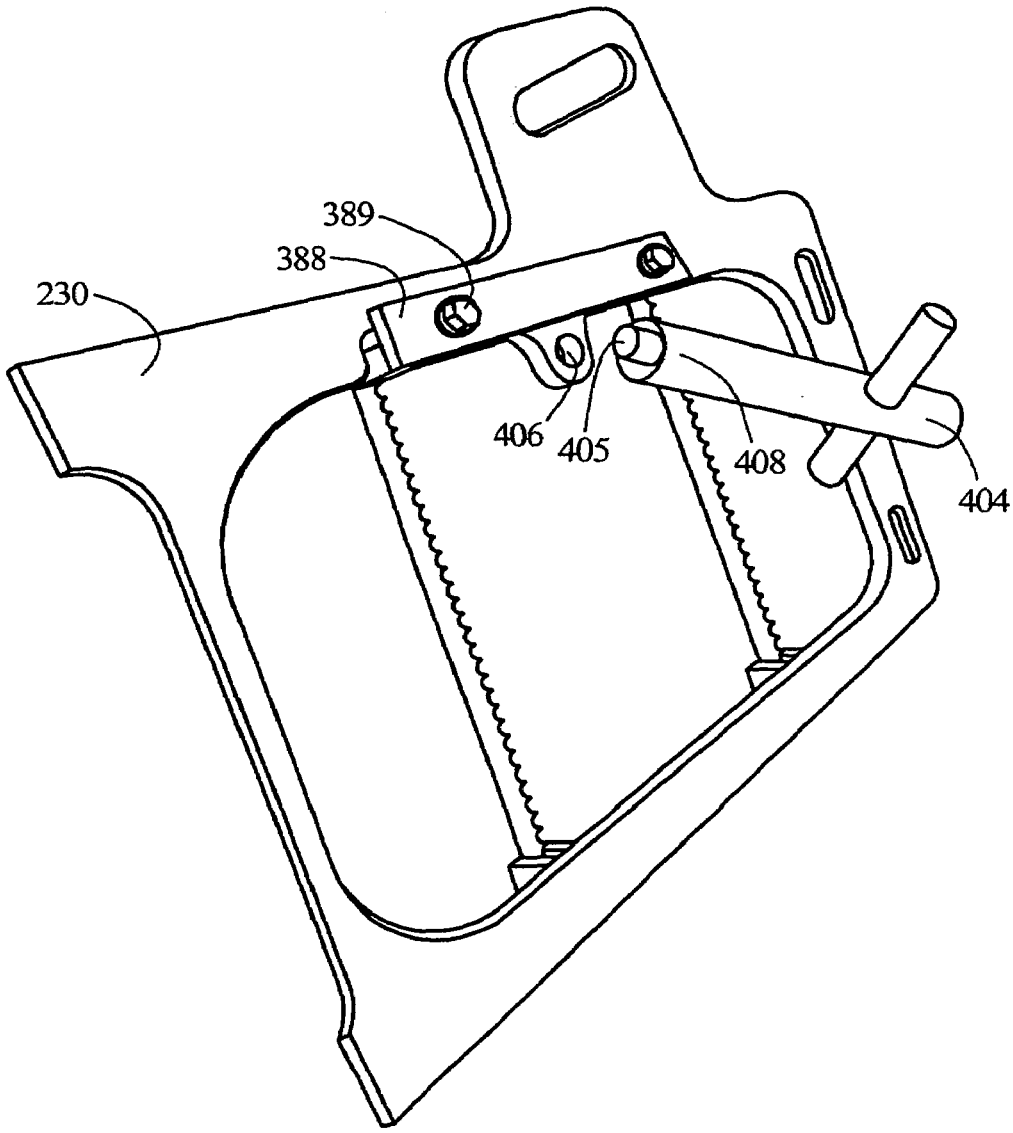
FIG. 17 is a fragmentary perspective view of a portion of the first frame of the cutting assembly showing a tool about to be engaged to the cutting assembly.
Figure 18:
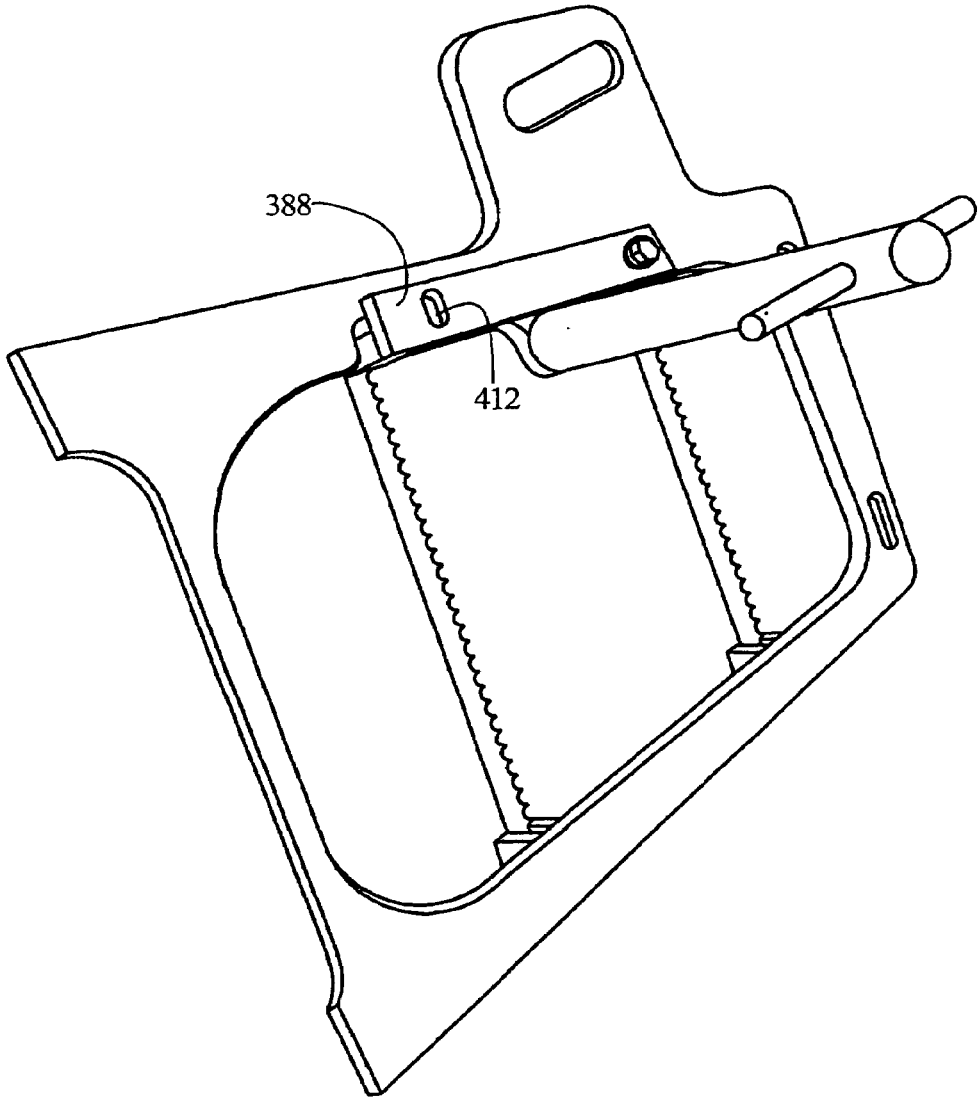
FIG. 18 is a fragmentary perspective view of the tool of FIG. 17 engaged to the first frame of the cutting assembly.

FIGS. 16-18 illustrate the installation of the blades 372, 374, 376 and 378. To install the blades 372, 374, 376, 378, each plate 388 is loosened from the frame and each blade is installed between the respective lugs 383*a*, 383*b* and 391*a*, 391*b* with the through-pins 401, 393 inserted into the channels 385*a*, 385*b*, 387*a*, 387*b*, respectively.

The retainer plate 388 is forced upwardly to draw the blades taunt by a tool 404 (shown in FIGS. 17 and 18) having one eccentrically located pin 405 inserted into a hole 406 of the frame 230. By rotating the tool about the pin 405, a cylindrical body 408 of the tool acts as a cam to force the plate 388 upwardly from the frame. The fasteners 389 reside in oval holes 412 (shown in FIG. 18 without the fastener) in the plate 388 which allow for vertical adjustment. When the blades are drawn taut, the fasteners 389 can be tightened to fix the vertical position of the plate 388 with respect to the frame 230.

Figure 15:
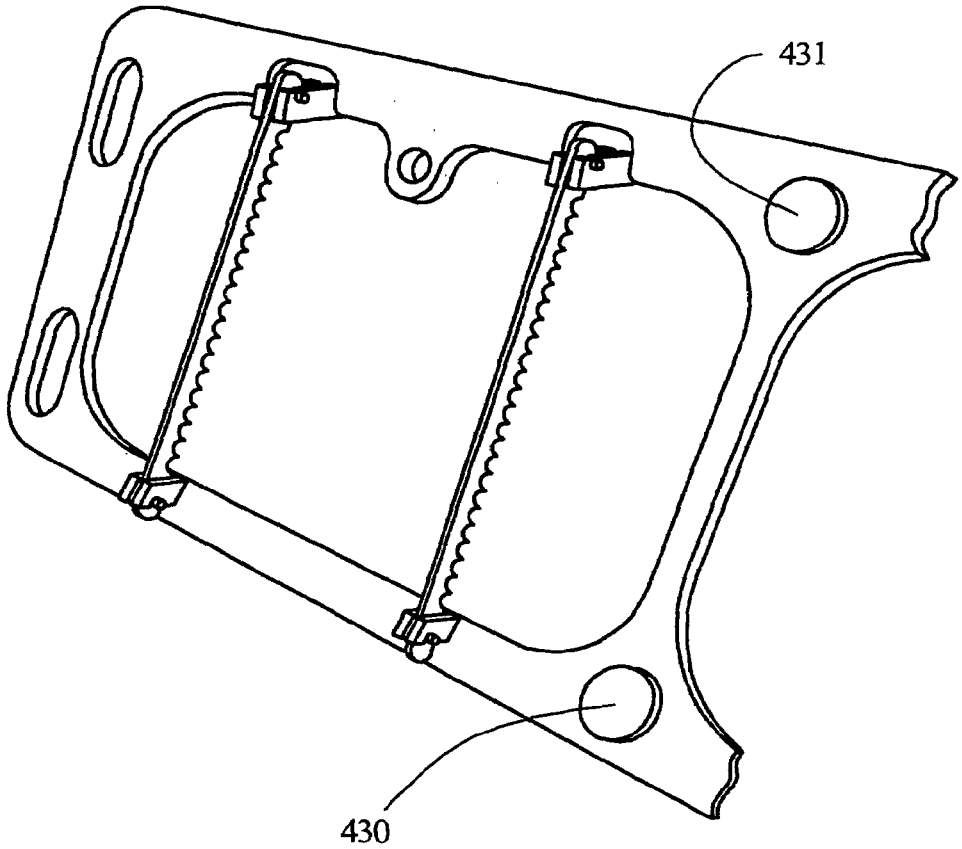
FIG. 15 is a fragmentary perspective view of a portion of the first frame of the cutting assembly.

FIG. 15 also shows mushroom shaped plastic buttons 430, 431 which prevent direct sliding contact between the frame 230 and the housing 220.

Figure 6:
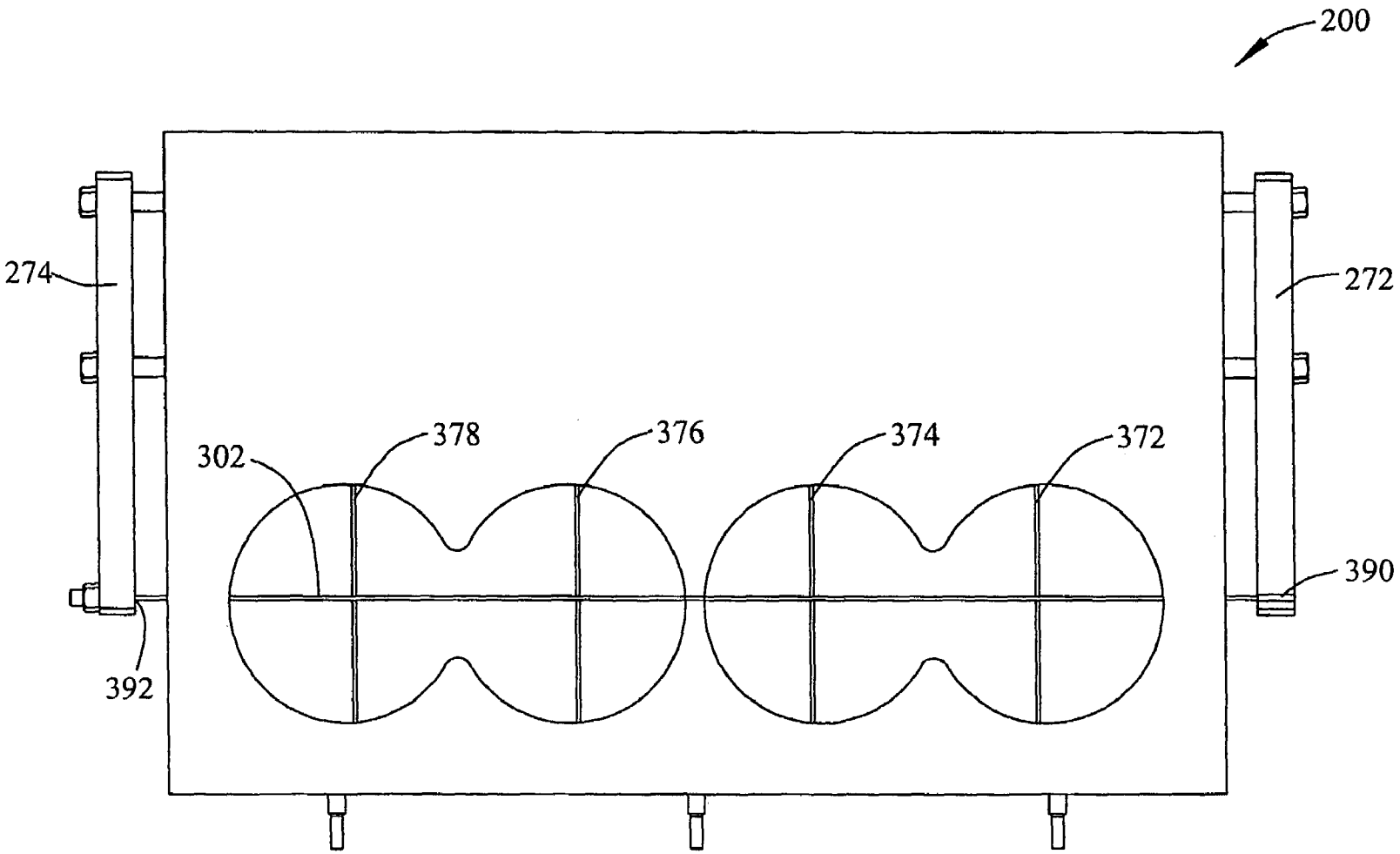
FIG. 6 is a front view of the cutting assembly of FIG. 2.
Figure 10:
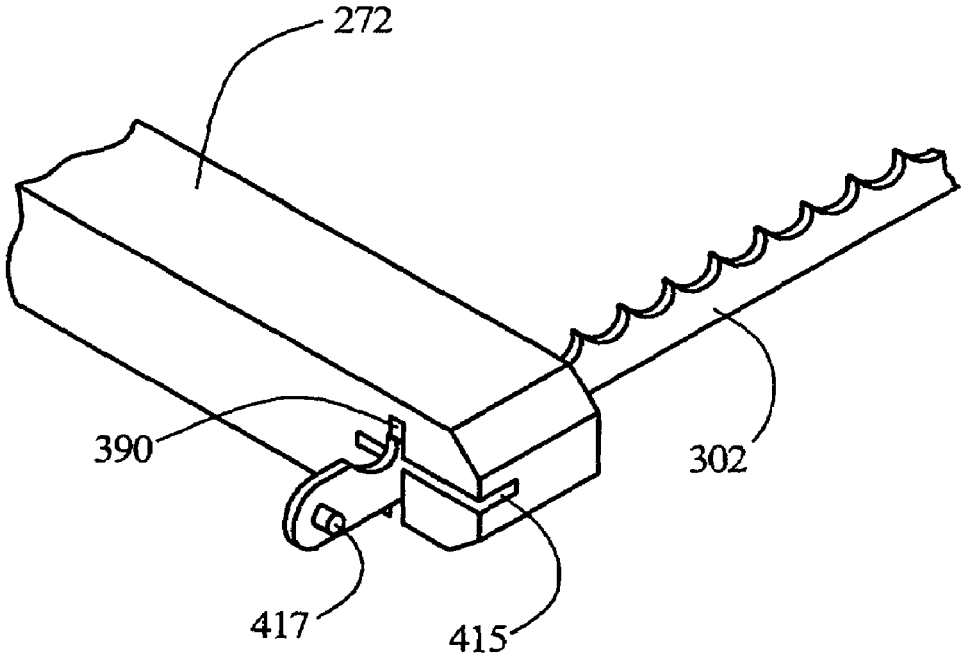
FIG. 10 is a fragmentary, exploded perspective view of a portion of the second frame.

As shown in FIGS. 6 and 10, the second frame 260 includes a blade slot 390 on one end plate 272 for receiving the horizontal longitudinal directed blade 302. A cross slot 415 accepts a through-pin 417 carried by the blade 302 to fix the blade 302.

Figure 9:
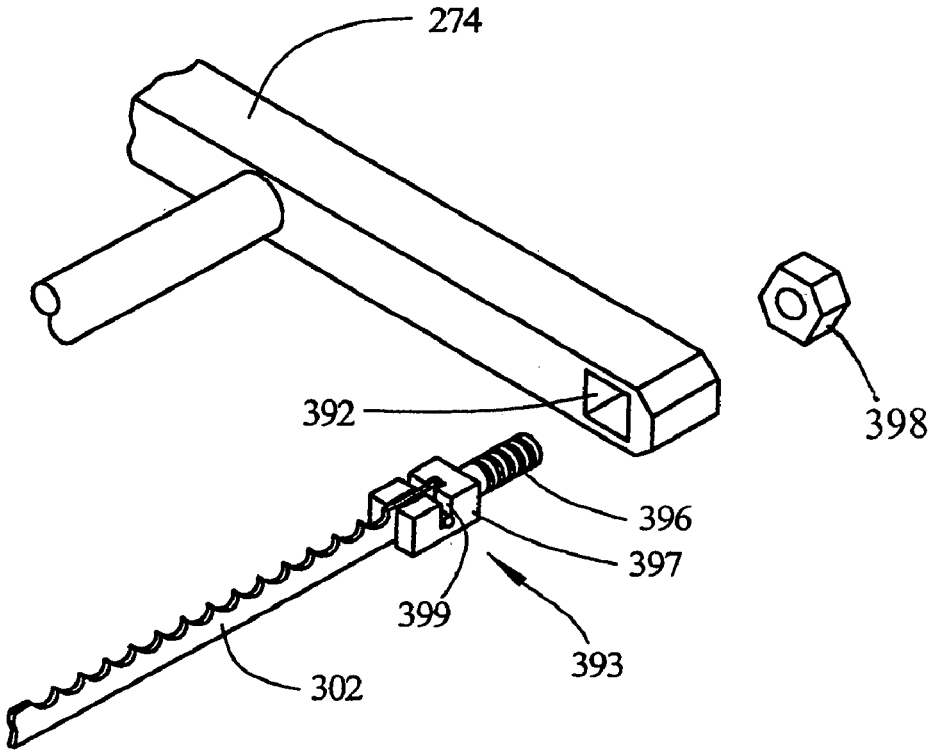
FIG. 9 is a fragmentary, exploded perspective view of a portion of the second frame of the cutting assembly.
Figure 9A:
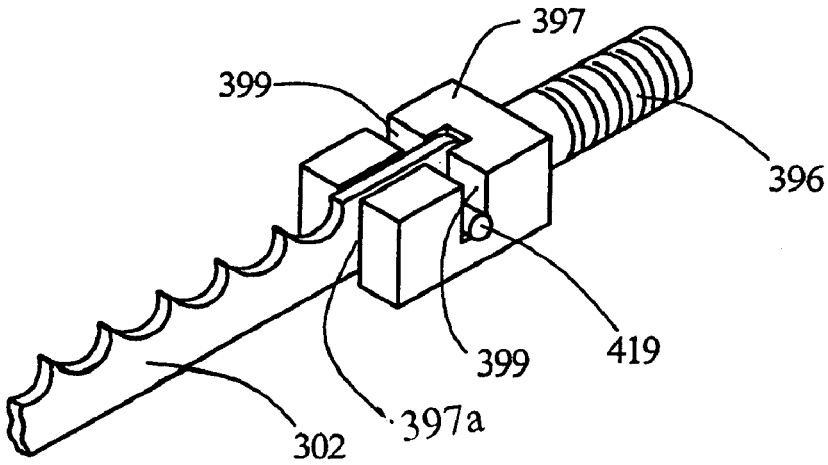
FIG. 9*a* is a fragmentary, perspective view of a portion of the second frame.

As shown in FIGS. 9 and 9A, the blade 302 is connected to a tightening fixture 393. The tightening fixture 393 includes a block 397 having a blade insert channel 397*a* and a pin channel 399 for receiving a through-pin 419 carried by the blade 302. A tightening stud 396 is connected to the block 397 and is engageable to a nut 398 on an outside of the end plate 274. The fixture 393 inserts into a square hole 392 through the end plate 274. The square block 397 fits snugly inside the hole 392 to prevent rotation of the blade 302 during tightening. The horizontal, longitudinally directed blade 302 is tensioned by tightening the nut 398 and drawing the tightening stud outwardly.

Figure 3:
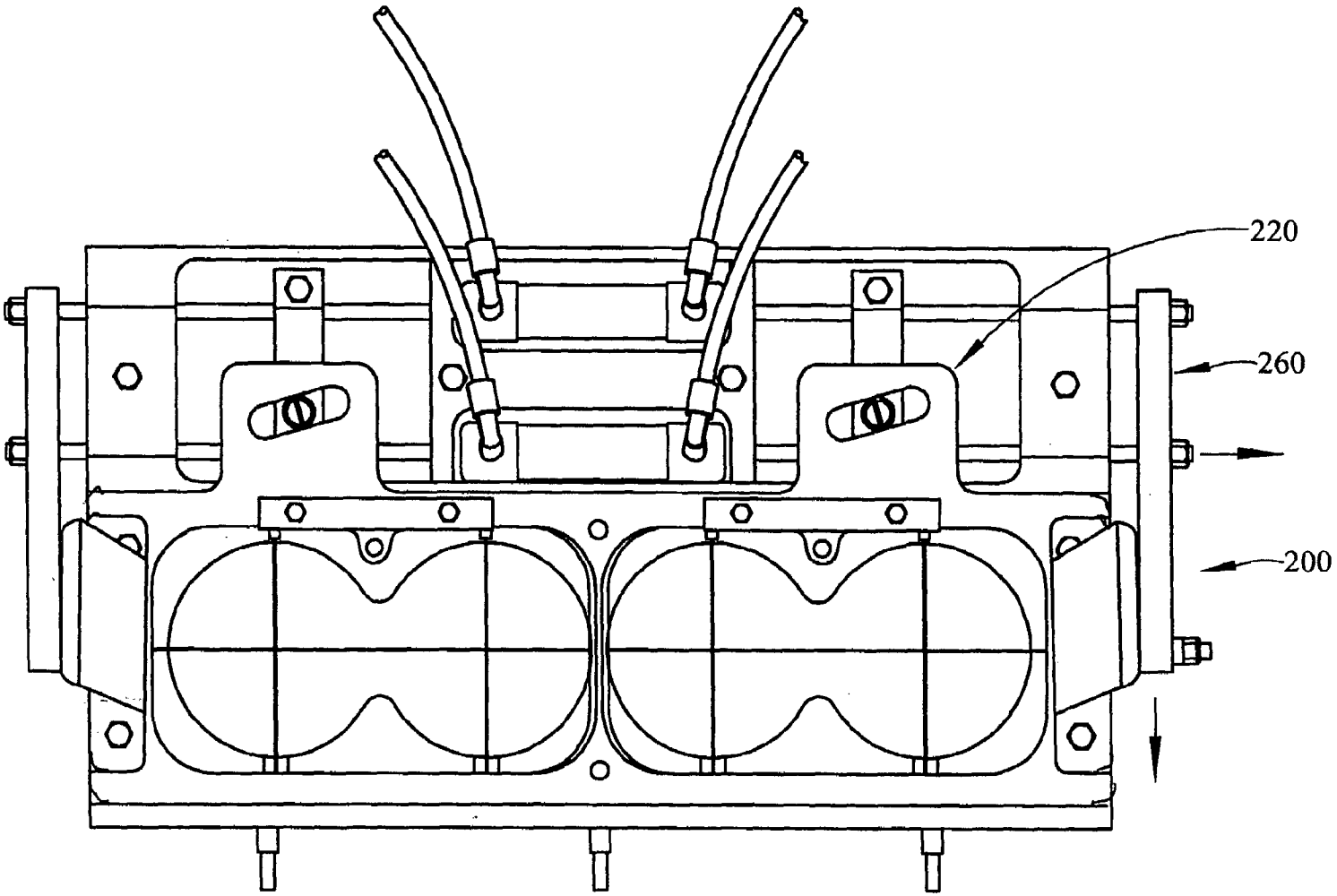
FIG. 3 is a rear view of the cutting assembly of FIG. 2 in a second position.
Figure 4:
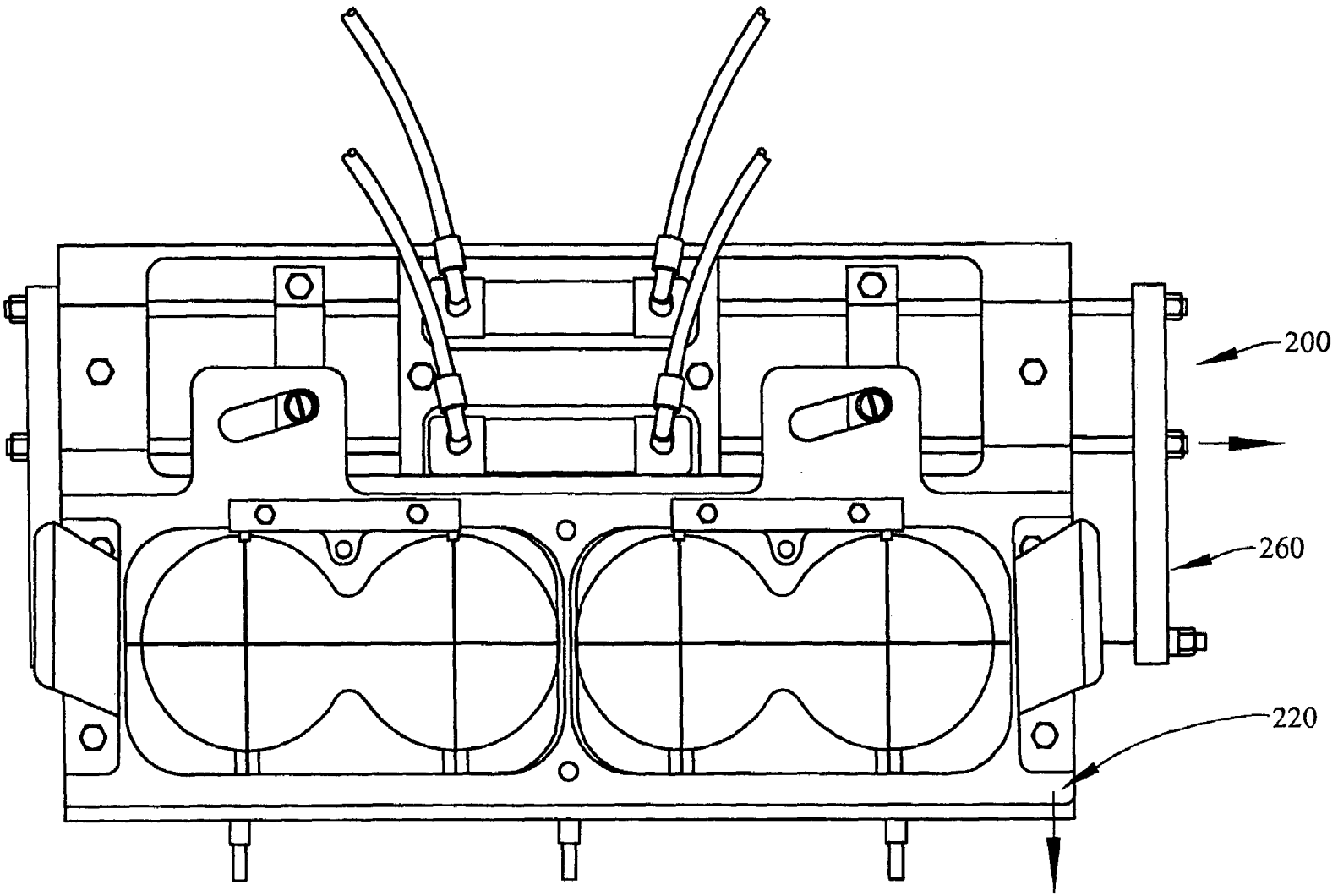
FIG. 4 is a rear view of the cutting assembly of FIG. 3 in a third position.
Figure 5:
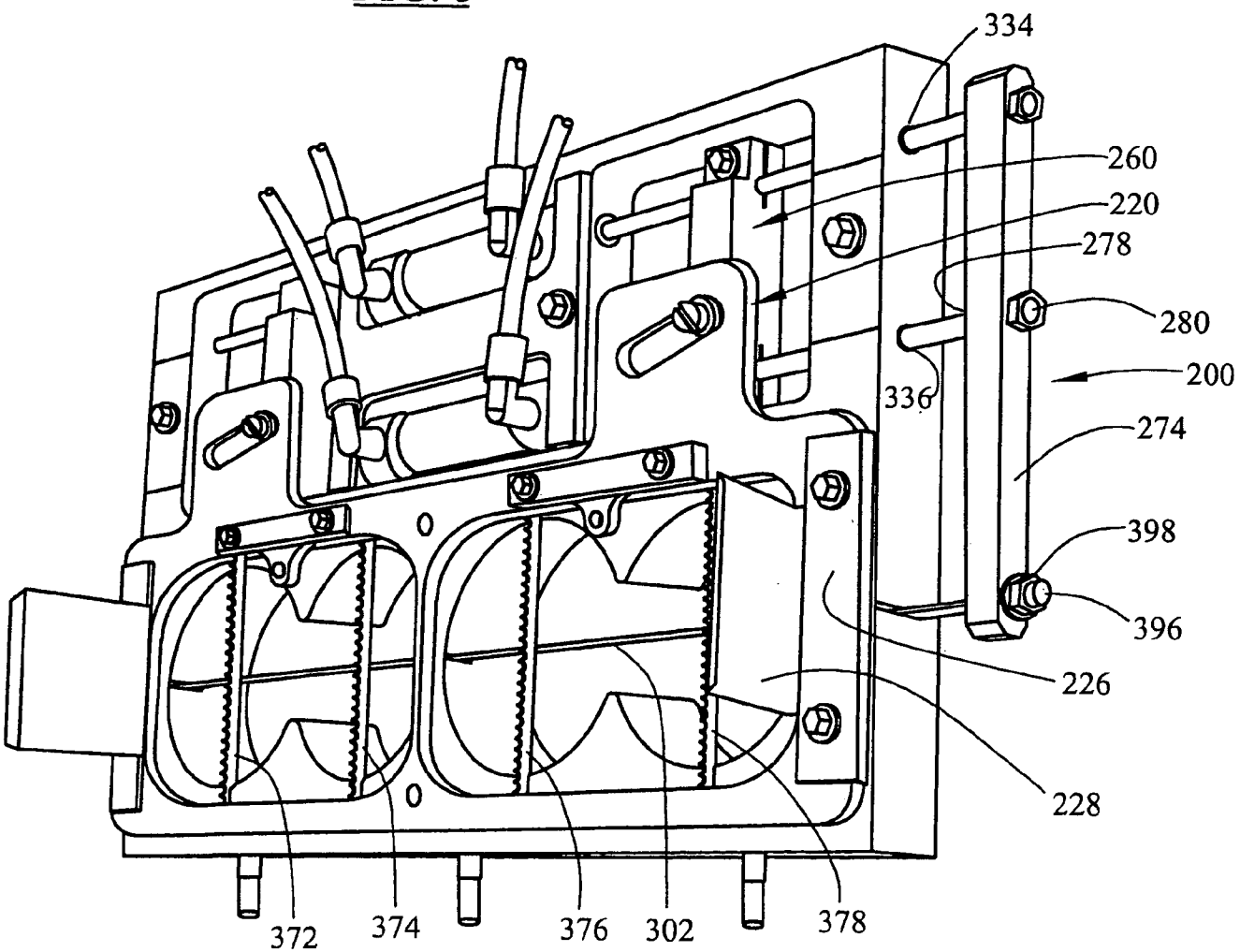
FIG. 5 is a rear perspective view of the cutting assembly of FIG. 4.

FIGS. 2, 3, and 4 show a progressive, reciprocating movement of the first frame 220 downwardly and the second frame 260 to the right. Both frames move in reciprocating fashion to longitudinally reciprocate their respective blade or blades to divide into four quarter pieces the food loaves conveyed though the voids 210, 212, 214, 216.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. The cutting assembly, comprising:

a housing;

a first frame supporting a first longitudinal blade, said first blade extending in a first direction, said first frame carried on said housing and guided for reciprocation with respect to said housing in said first direction to reciprocate said first blade therewith in said first direction, wherein substantially the entire first frame moves unitarily in said first direction;

a linear moving device comprising a pressurized fluid-actuated piston within a cylinder, one of said piston or said cylinder mounted to said housing and the respective other of said piston or said cylinder connected to said first frame for reciprocating the first frame linearly as said piston is reciprocated linearly within said cylinder;

a second frame carried on said housing and guided for linear reciprocation with respect to said housing in a second direction, wherein substantially the entire second frame moves unitarily in said second direction, the second frame supporting a second longitudinal blade for reciprocation therewith in said second direction, said second blade extending in said second direction and at an angle to the first blade;

at least one slot arranged on one of said first and second frames and at least one follower arranged on the other of said first and second frames and located within said slot, said slot having an inclination to the first direction for reciprocating the second frame in said second direction, whereby the reciprocating movement of said first frame causes the reciprocating movement of said second frame;

said first and second blades arranged to cut a product along intersecting cut planes.

2. The cutting assembly according to claim 1, wherein said cylinder is configured to be fluid pressurized on either side of said piston to move said piston in reversing directions.

3. A slicing machine comprising:

a food loaf delivery path arranged in a longitudinal direction;

a cutting assembly arranged in the delivery path, the cutting assembly comprising:

a housing, a first frame supporting a longitudinal first blade, said first blade extending in a first direction, said first frame carried on said housing and guided for reciprocation with respect to said housing in said first direction to reciprocate said first blade therewith in said first direction, wherein substantially the entire first frame moves unitarily in said first direction, a linear moving device mounted to said housing and directly coupled to said first frame for reciprocating the first frame, a second frame carried on said housing and guided for reciprocation with respect to said housing in a second direction, wherein substantially the entire second frame moves unitarily in said second direction, the second frame supporting at least one longitudinal second blade for reciprocation therewith in said second direction, said second blade extending in said second direction and at an angle to said first blade, at least one slot arranged on one of said first and second frames and at least one follower arranged on the other of said first and second frames and located within said slot, said slot having an inclination to the first direction for reciprocating the second frame in said second direction, whereby the reciprocating movement of said first frame causes the reciprocating movement of said second frame, wherein the first and second blades are arranged to cut a product through intersecting planes; and a slicing knife arranged in the delivery path downstream of the cutting assembly, the slicing knife arranged to slice food loaves transversely to the longitudinal direction of said delivery path in a transverse cutting plane;

said housing located between said cutting plane and the reciprocating first blade, said housing having at least two voids therethrough for guiding two food loaves into the transverse cutting plane, wherein said first blade spans across said two voids and acts to substantially simultaneously cut two food loaves in a first longitudinal cutting plane perpendicular to said transverse cutting plane, said first blade driven independently from said slicing knife.

4. The slicing machine according to claim 3, the second frame having a pair of the longitudinal second blades, each second blade being at said angle to the first blade, each second blade being located in registry with a respective one of said voids;

wherein each second blade is arranged to cut a respective loaf along a respective second longitudinal cutting plane that is at said angle to the first longitudinal cutting plane.

5. The slicing machine according to claim 3, wherein the longitudinal second blade is perpendicular to the first blade.

6. The slicing machine according to claim 3, wherein the linear moving device comprises a dual acting cylinder coupled to said first frame and operable to reciprocate said first frame.

7. The slicing machine according to claim 3, wherein said intersecting planes are perpendicular.

8. The slicing machine according to claim 3, wherein said at least one second blade comprises a plurality of second blades, said second blades carried by said second frame and arranged in parallel and spaced-apart.

9. A cutting assembly, comprising:

a housing;

a first frame supporting a longitudinal first blade, said first blade extending in a first direction, said first frame carried on said housing and guided for reciprocation with respect to said housing in said first direction to reciprocate said first blade therewith in said first direction, wherein substantially the entire first frame moves unitarily in said first direction;

a linear moving device mounted to said housing and directly coupled to said first frame for reciprocating the first frame;

a second frame carried on said housing and guided for reciprocation with respect to said housing in a second direction, wherein substantially the entire second frame moves unitarily in said second direction, the second frame supporting at least one longitudinal second blade for reciprocation therewith in said second direction, said second blade extending in said second direction and at an angle to said first blade;

at least one slot arranged on one of said first and second frames and at least one follower arranged on the other of said first and second frames and located within said slot, said slot having an inclination to the first direction for reciprocating the second frame in said second direction, whereby the reciprocating movement of said first frame causes the reciprocating movement of said second frame;

wherein the first and second blades are arranged to cut a product through intersecting planes.

10. The cutting assembly according to claim 9, wherein said linear moving device comprises a dual acting cylinder operatively connected to said first frame and operable to reciprocate said first frame.

11. The cutting assembly according to claim 9, wherein said intersecting planes are perpendicular.

12. The cutting assembly according to claim 9, wherein said at least one second blade comprises a plurality of second blades, said second blades carried by said second frame and arranged in parallel and spaced-apart.

* * * * *